United States Patent [19]

Piche

[11] 3,979,932

[45] Sept. 14, 1976

[54] ADJUSTABLE COMBINATION LOCK KEY SAFE

[76] Inventor: Paul E. Piche, 3698 Locust, Lake Orion, Mich. 48035

[22] Filed: May 19, 1975

[21] Appl. No.: 578,398

[52] U.S. Cl. ..... 70/63; 70/26

[51] Int. Cl.[2] ..... E05B 65/52

[58] Field of Search ..... 70/63, 25, 26, 57, 58, 70/315–318; 109/23, 52

[56] References Cited

UNITED STATES PATENTS

| | | | |
|---|---|---|---|
| 669,295 | 3/1901 | Wendel | 70/25 |
| 1,955,809 | 4/1934 | Hobbs | 109/23 |
| 3,436,937 | 4/1969 | Barrett | 70/63 |
| 3,695,067 | 10/1972 | Bays | 70/63 |
| 3,712,091 | 1/1973 | Parent | 70/63 |
| 3,721,384 | 3/1973 | Pierce | 70/63 X |

*Primary Examiner*—Robert L. Wolfe
*Attorney, Agent, or Firm*—Remy J. VanOphem

[57] ABSTRACT

An adjustable combination lock key safe includes telescoping inner and outer stamped sheet metal cylinders, the outer of which releasably carries a U-bolt shackle for securing the key safe to a mounting member such as a door knob and the inner of which carries locking means adapted to lockingly engage the shackle and outer cylinder to thereby maintain a secured relationship therebetween, the inner cylinder including a storage area for retaining contents such as a key or other desired limited access articles and having a multiple disc combination lock with an outer knob and dial for effecting release of the locking means and an inner adjustable dial for changing the combination of the lock whereby the key depositor may select a unique combination so as to provide limited access to the key safe for use of the contents therewithin.

10 Claims, 5 Drawing Figures

ADJUSTABLE COMBINATION LOCK KEY SAFE

The present invention relates to article safes and, in particular, to a key safe or like article providing limited access to an interior compartment by means of an adjustable combination lock.

The problem of providing limited access to premises such as a home or business for use, delivery or service has received increased attention recently. For security purposes and to guard against uncontrolled entry or use, it is desirable to restrict availability of the required key or information.

One approach such as Barrett U.S. Pat. No. 3,036,937 has been to use a die cast housing having means for mounting on a door knob or other article and having a releasable cover member providing access to an interior compartment which is locked thereto by a key operated lock. This approach, however, is not entirely satisfactory. In the first instance, entry can be accomplished only by delivery of a master key to the designated user. This necessitates return of the key after use and opens the possibility of unwanted duplication of the master key so as to provide access by undesignated persons. Additionally, the die cast construction can be impact shattered thus providing unwanted access to the contents. In another construction, a hinged split cylinder is secured over a door knob and contains therewith a key or like article. A master key and lock provides access. This construction is likewise subject to key duplication, return of keys, and tampering. Various safe deposit devices such as Newbauer U.S. Pat. No. 1,934,319 and Pierce U.S. Pat. No. 3,721,384 have also proposed the use of a combination lock to avoid the necessity of delivering keys to designated persons. However, unless the designated person is permitted unrestricted use or access to the device or premises controlled by the contents, the possibility of unauthorized access and duplication via informing third parties remains.

An adjustable combination lock key safe made in accordance with the present invention overcomes the aforementioned problems by providing a device to which access can be given by the owner for a limited time frame during which the designated person can perform the needed service, use or visitation and after which the combination code can be readily changed to provide access to succeeding individuals on a new information basis, a key safe which is highly resistant to tampering or breakage, and a device made substantially entirely of easy to fabricate stampings.

More particularly, my key safe comprises stamped inner and outer telescoping cylinders. The outer cylinder includes a spherical dome having a pair of openings therein for slidably receiving the spaced legs of a U-shaped shackle which is releasably retained thereon by a pair of snap rings. The dome also carries a pair of pivotable locking bars which are cammed by insertion of the inner cylinder into locked engagement with notches in the shackle legs. The lower cylinder includes a base section carrying the combination lock mechanism, a middle section for carrying the key or other contents, and an upper section for camming the locking bars against the shackle. The combination lock includes a plurality of stacked discs including a plurality of pins engagable with adjacent pins. The upper disc is engagable with a clutch cone knob. The knob includes indicia which is referenced by a pointer carried by the disc axle. When the knob is depressed, the clutch is engaged and the knob and the first disc rotate with respect to the pointer and the first set of pins to thereby change the lock combination. Upon proper knob rotation in accordance with the code, the discs are aligned with notches in lock bars. This permits rotation of a secondary exterior knob which is operatively coupled to a second pair of slidable locking bars engaged with the outer cylinder. The locking bars are retracted to permit separation of the cylinders. In addition to the obvious advantages of the adjustable combination feature, the basic stamped construction guards against tampering or forced entry. Any attempt to smash or crumple the key safe deforms the parts into a more secure engaged relationship thereby discouraging entry.

The above and other features and advantages of my invention will be apparent to those skilled in the art by reference to the following description and drawings illustrating a preferred embodiment wherein.

Figure 1:
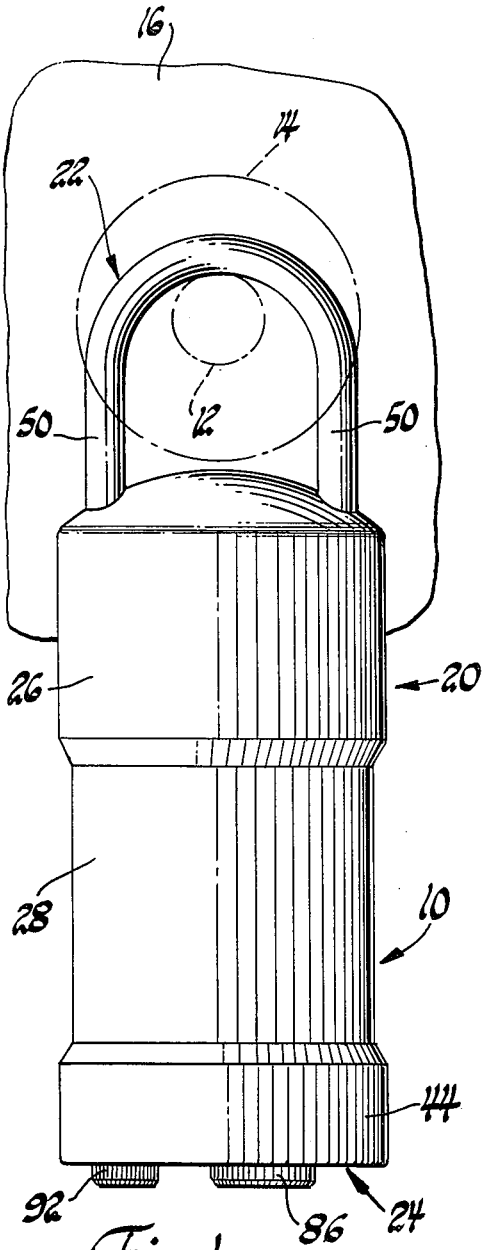
FIG. 1 is a side elevational view illustrating an adjustable combination lock key safe made in accordance with the present invention carried on a door knob shown in dotted lines.

Referring to the drawings, and in particular to FIG. 1, there is shown an adjusting combination lock key safe 10 made in accordance with the present invention carried on the stem 12 of a door knob 14 which is coupled to a conventional door lock mechanism for a door 16. This key safe 10 may obviously however be secured to any suitable fixed surface adapted to be engaged thereby. The key safe 10 carries in the interior thereof, as described in detail below, a key or other contents for providing access or entry to devices controlled thereby for designated persons having the predetermined access code. For instance, the interior key may provide access to a home, apartment, car, boat, compartment or the like or contain information desired to be given on a restricted basis.

The key safe 10 generally comprises an outer cylinder 20, a shackle 22, and an inner cylinder 24.

The outer cylinder 20 includes a stamped upper dome section 26, a stamped lower sleeve section 28, a section 30, a pair of shackle sleeves 32, and a pair of locking bars 34. The dome section 26 includes spherical dome having two laterally spaced recessed notches 36 having circular openings 38 therein registering with the shackle sleeves 32 and a cylindrical skirt 40. The locking bars 34, as described in greater detail below, are pivotally connected to the dome and are pivotable with respect to the openings 38. The lower sleeve section 28 includes an upper portion 42 telescopically received within the skirt 40 and securely fastened thereto, and an enlarged lower portion 44 having a reversely bent interior annular rim 46. The reinforcing section 30 is arcuate and is secured to the interior surfaces of the dome, the skirt 40 and the lower sleeve section 28 and provides interior reinforcement for the upper cylinder 20. The shackle sleeves 32 are suitably secured to the inner surface of the skirt 40 and each includes an axial passage for receiving the depending legs 50 of the hardened steel shackle 22. The legs 50 include axially spaced notches 51 for receiving the locking bars 34, and retaining a snap ring 52. The snap rings 52 engage annular grooves in the shackle legs 50 to releasably retain legs in the absence of locking engagement by the locking bars 34. The legs 50 each are provided with V-shaped notches 51 engaged by corresponding V-shaped projections 56 on the locking bars 34, and camming surfaces 58. The cooperation of the projections 56 with the notches 51 securely locks the shackle 22 to the upper cylinder 20.

Figure 2:
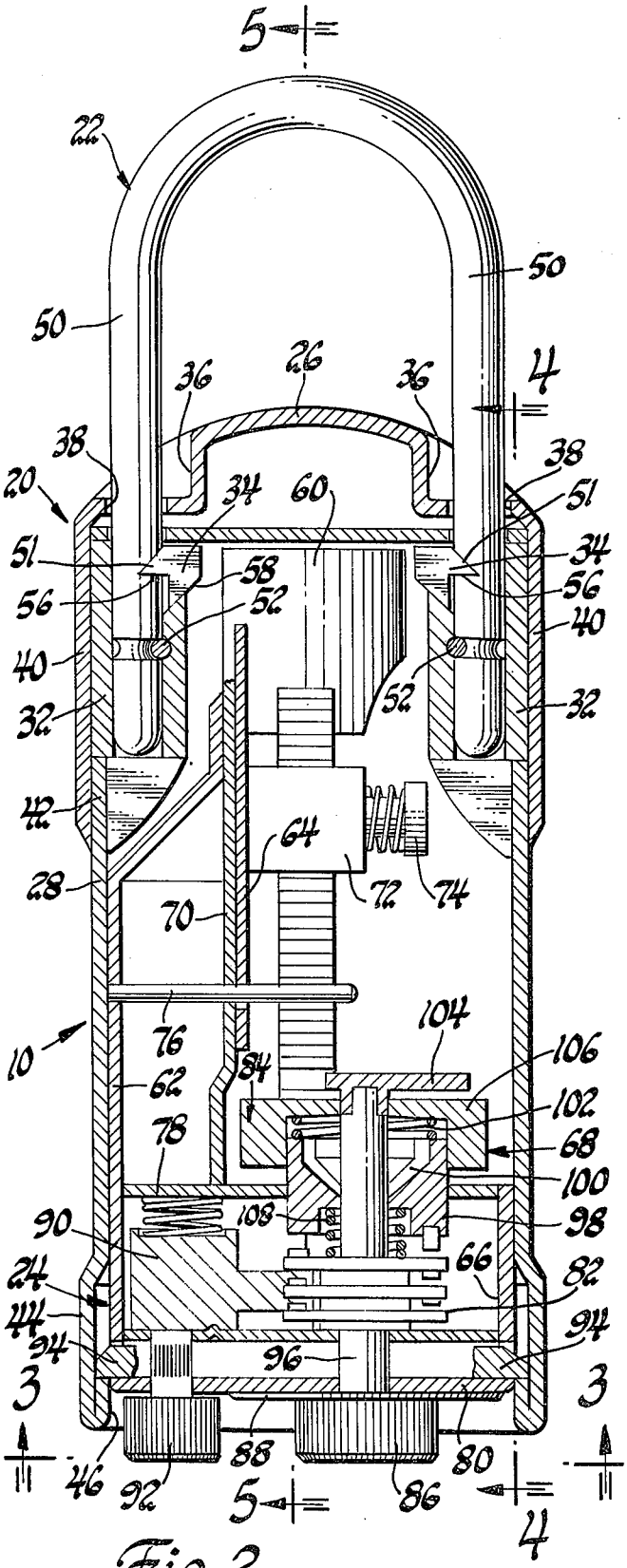
FIG. 2 is a side cross-sectional view similar to FIG. 1 showing the interior construction of the key safe.
Figure 3:
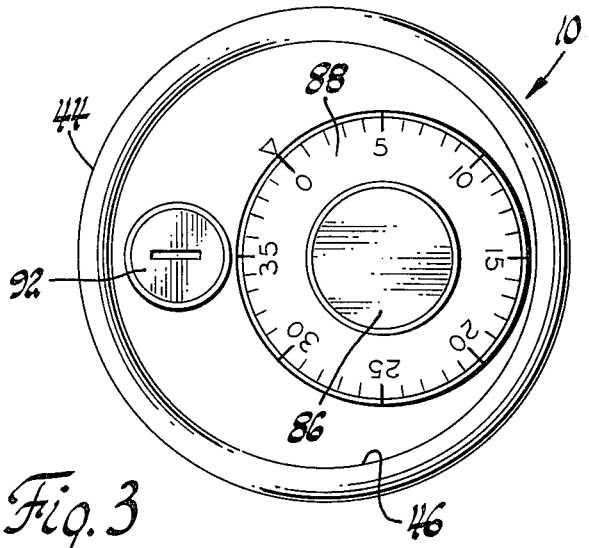
FIG. 3 is a view taken along line 3—3 of FIG. 2 showing the combination dial and actuating knob.
Figure 4:
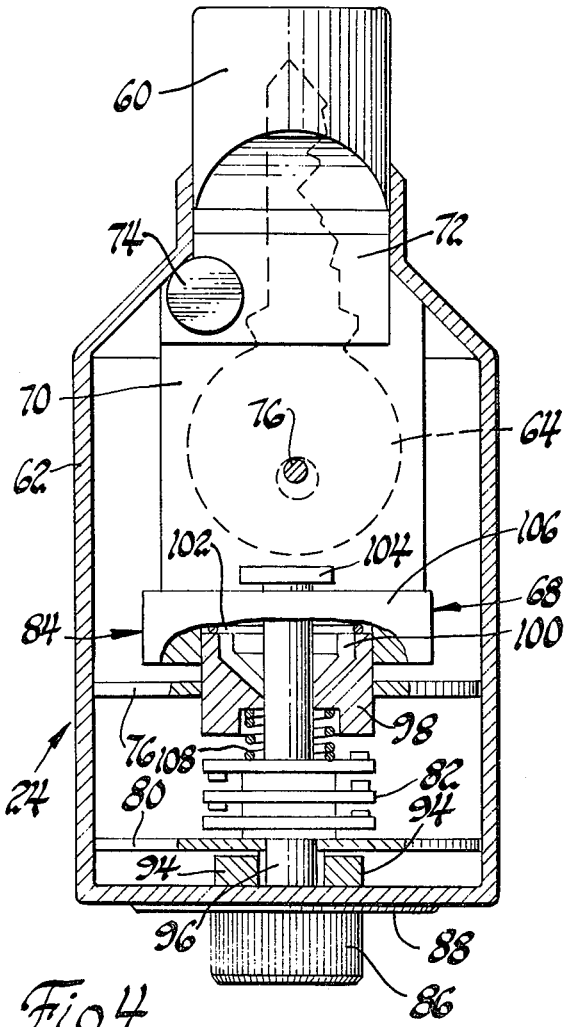
FIG. 4 is a side view of the lower cylinder alone taken generally along line 4—4 of FIG. 2.
Figure 5:
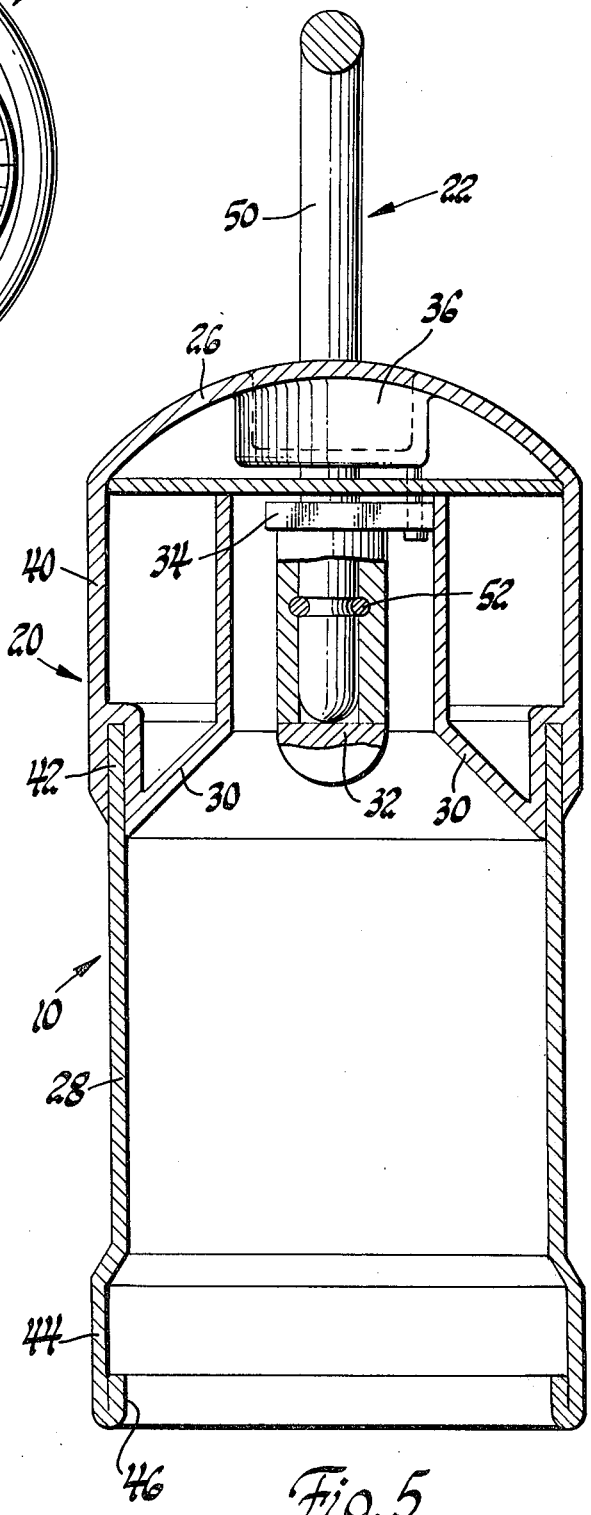
FIG. 5 is a cross-sectional view of the upper cylinder and shackle showing interior details of construction.

The inner cylinder 24 as shown in FIGS. 2 and 4 includes an upper plug section 60 which engages the camming surfaces 58 of the locking bars 34 upon insertion of the lower cylinder 24, an arcuate middle compartment section 62 for retaining a key 64 or other contents, and a lower base section 66 carrying an adjustable combination lock assembly generally indicated by the numeral 68. The plug section 60 includes a depending leg 70 to which a spring biased clip 72 is slidably attached on pin 74 attached for fixedly clamping the key 64 thereto. The hole in the key is axially positioned on a pin 76 fixed to section 62.

The base section 66 includes axially spaced circular upper and lower walls 78 and 80 respectively. The lock assembly 68 is generally contained therewithin the base section 66 and comprises a combination disc assembly 82, the respective discs of which are axially separated by washers, a combination adjustment assembly 84, a combination knob 86 and dial 88, a lock dog 90 operable by an adjusting knob 92 to extend or retract a pair of locking bars 94.

The knob 86 is connected to spindle 96 on which the discs and washers are journalled. An upper disc cylinder 98 journalled at the upper end of the spindle 96 extends through an aperture in the upper wall and includes conical recess in the upper surface thereof. The discs each carry thereon intergauging pins which when selectively rotate according to a predetermined code will align the discs in a discrete angular relationship in which notches, not shown, will be axially aligned and permit rotation of the lock dog 90 by means of actuating knob 92. A clutching cone 100 is engagable with the recess against the biasing of spring 102. A pointer 104 is carried at the upper end of cone 100. A combination changing knob 106 is slidably carried on cone 100. By depressing knob 106 against the biasing of the spring 104, the disc cylinder 98 rotates with respect to the upper disc to change the combination code as determined by a code schedule referenced by the relationship between the pointer 104 and indicia on the upper surface of knob 106. Accordingly, each individual lock is accompanied by a schedule to permit the owner to select a variety of codes.

Upon dialing the correct combination, the designated user in possession of the code as relayed by the owner, rotates the knob 92. The knob 92 is operatively connected to the locking bars 94 by a spring biased rack and pinion arrangement to retract the latter against the biasing spring past the lip 46 to permit axial separation of the inner and outer cylinders and thereby provide access to the key 64. The accompanying withdrawal of the plug section 60 allows the locking bars 34 to release from the shackle legs 52 to permit the upper cylinder to be removed from the knob 14.

It will thus be appreciated that the above adjustable combination key safe provides a unique way for providing a limited time access to selected premises for a plurality of users. The stamped construction negates tampering and provides a rugged durable construction.

While a preferred embodiment of my key safe has been disclosed, many modifications and improvements thereof will be apparent to those skilled in the art without departing from the spirit and scope thereof, and accordingly it is to be limited only in accordance with the claims that follow.

What is claimed is:

1. An adjustable combination lock safe which can be set to a plurality of discrete lock combinations to provide limited and variable access thereto comprising:

telescoping inner and outer members defining in assembly relationship a compartment adapted to secure contents therewithin;

shackle means releasably carried by the outer member for retaining the safe on a mounting member;

first lock means carried by the inner member adapted to be actuated to lockingly engage the shackle means to prevent separation thereof;

actuating means carried by the inner member operable upon telescopic insertion into the outer member to actuate the first lock means to effect locking engagement with the shackle means;

second lock means lockingly engagable between the inner and outer members to prevent telescopic separation thereof;

adjustable combination lock means operatively connected to the second lock means for unlocking the latter upon dialing a predetermined changeable code to permit separation of the members and thereby provide access to the contents therewithin.

2. The key safe according to claim 1 wherein the adjustable combination lock means includes an adjusting knob disposed within the compartment which can be adjusted to vary the lock combination.

3. The key safe according to claim 1 wherein the inner and outer members are formed from deformable sheet metal stamping whereby attempted forced separation of the members will deform the members into a more secure engaged relationship.

4. The key safe according to claim 2 wherein the combination lock means includes a plurality of interengaging discs defining a discrete combination for effecting release of the second lock means, one of which can be angularly changed by the adjusting knob to vary the lock combination according to a predetermined schedule.

5. The key safe according to claim 1 wherein the first lock means and the inner member include engaging camming surfaces for camming the first lock means into locking engagement with the shackle means upon insertion of the inner member.

6. The key safe as recited in claim 4 wherein the adjustable combination means includes a rotatable actuating knob which is rotatable only upon operator dialing of the correct lock combination and is operatively connected to the second lock means to retract the latter upon rotation thereof.

7. The key safe as recited in claim 6 wherein the second lock means is operatively connected to the actuating knob by a rack and pinion drive.

8. The key safe as recited in claim 7 wherein the inner member includes releasable clip means for retaining the contents of the safe.

9. The key safe as recited in claim 7 wherein the actuating knob is releasably coupled to the said one disc by a conical friction clutch cone.

10. The key safe as recited in claim 5 wherein the shackle means comprises a U-bolt having legs depending within the outer member which are releasably carried on the outer member by snap rings and which include notches therein engaged by the first lock means to effect the locking engagement.

* * * * *